US008303342B2

(12) United States Patent
Shi et al.

(10) Patent No.: US 8,303,342 B2
(45) Date of Patent: Nov. 6, 2012

(54) SHIELDED ELECTRICAL CONNECTOR

(75) Inventors: Hou-Yu Shi, Kunshan (CN); David Ko, Fullerton, CA (US); Chang-Mao Li, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 400 days.

(21) Appl. No.: 12/578,593

(22) Filed: Oct. 14, 2009

(65) Prior Publication Data

US 2010/0093217 A1 Apr. 15, 2010

(30) Foreign Application Priority Data

Oct. 15, 2008 (CN) ..... 2008 1 0304939
Oct. 15, 2008 (CN) ..... 2008 2 0302421

(51) Int. Cl.
*H01R 13/648* (2006.01)

(52) U.S. Cl. ..... 439/607.41; 439/620.22; 439/686

(58) Field of Classification Search ..... 439/607.41, 439/620.22, 607.46, 701, 686, 695
See application file for complete search history.

(56) References Cited

U.S. PATENT DOCUMENTS

| | | | | |
|---|---|---|---|---|
| 5,397,246 | A * | 3/1995 | Defibaugh et al. | 439/352 |
| 6,866,539 | B2 * | 3/2005 | Chang | 439/460 |
| 7,086,889 | B2 * | 8/2006 | Yin et al. | 439/358 |
| 2009/0017684 | A1 * | 1/2009 | Lin | 439/610 |

FOREIGN PATENT DOCUMENTS

| | | | |
|---|---|---|---|
| CN | 2355458 | Y | 12/1999 |
| CN | 200987002 | Y | 12/2007 |

* cited by examiner

*Primary Examiner* — Tulsidas C Patel
*Assistant Examiner* — Travis Chambers
(74) *Attorney, Agent, or Firm* — Wei Te Chung; Ming Chieh Chang

(57) ABSTRACT

An electrical connector (100) includes a housing (1), a plurality of contacts (2) receiving in the housing, a metal shell (6), enclosing the housing and including two stopping tabs (620) formed at two sides of thereof, and two insulative cover (4,5), comprising cooperation structure (42) respectively to interfere with the two side of the stopping tabs and assembling to the metal shell along different directions.

11 Claims, 7 Drawing Sheets

SHIELDED ELECTRICAL CONNECTOR

BACKGROUND OF THE INVENTION

1. Field of the Invention

The present invention generally relates to an electrical connector, and more particularly to an electrical connector adapter for a consumer product.

2. Description of Related Art

Electrical connectors are widely applied to various electronic devices as an interconnection medium. A common electrical connector includes an insulative housing, a number of terminals received in the insulative housing and a metal shell enclosing the insulative housing. The metal shell is further enclosed by an insulative cover, with a front section of the metal shell exposed outside to form a mating interface. However, it is difficult to position the insulative cover when it is mounted onto the metal shell, as there is little gap between the insulative cover and metal shell, therefore a length of said mating interface is uncertain, which may influence proper interconnection between electrical connector and a complementary connector.

Hence, an electrical connector having an improved shell is desired to overcome the disadvantages of the related art.

SUMMARY OF THE INVENTION

Accordingly, an object of the present invention is to provide an electrical connector having an improved shell.

In order to achieve the object set forth, An electrical connector, comprises an insulative housing; a plurality of contacts received in the housing; a metal shell enclosing the housing and having two stopping tabs formed on two sides thereof; and an insulative cover having two parts assembled to the metal shell along opposite directions, said two parts of the cover each having a cooperation structure interfering with the stopping tabs of the metal shell.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
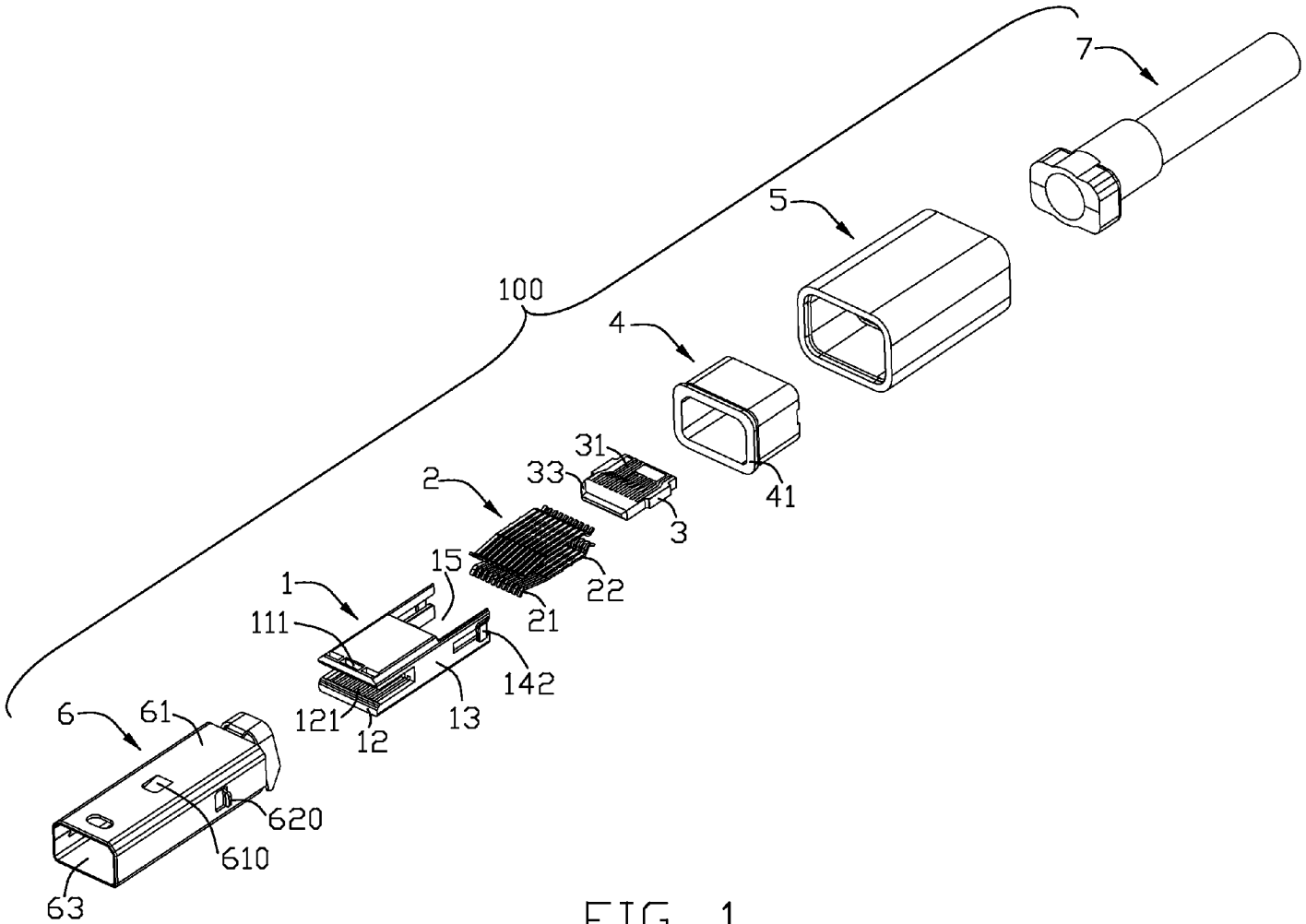
FIG. 1 is an exploded, perspective view of an electrical connector in accordance with the present invention.
Figure 2:
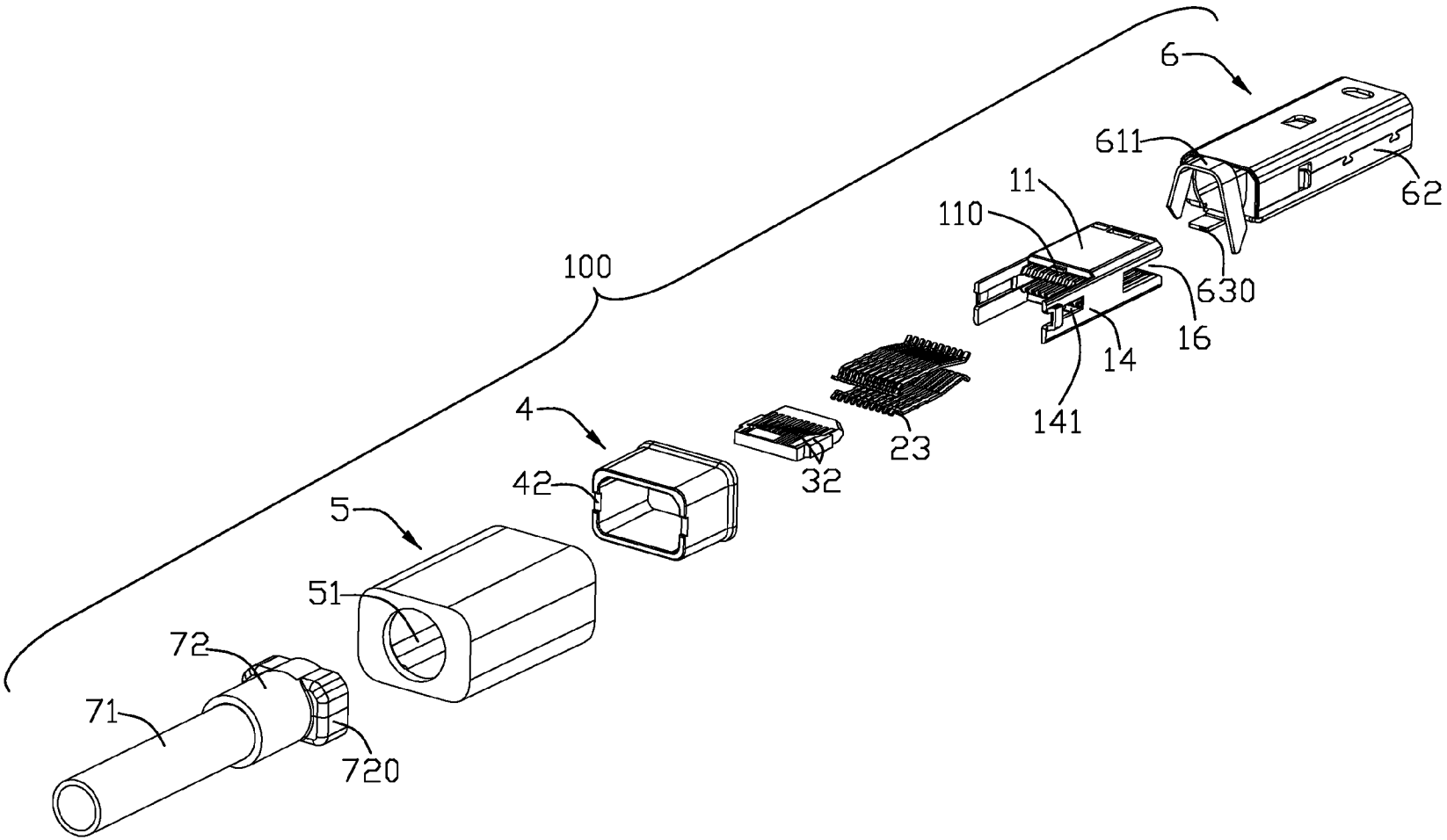
FIG. 2 is a view similar to FIG. 1, but viewed from another aspect.
Figure 3:
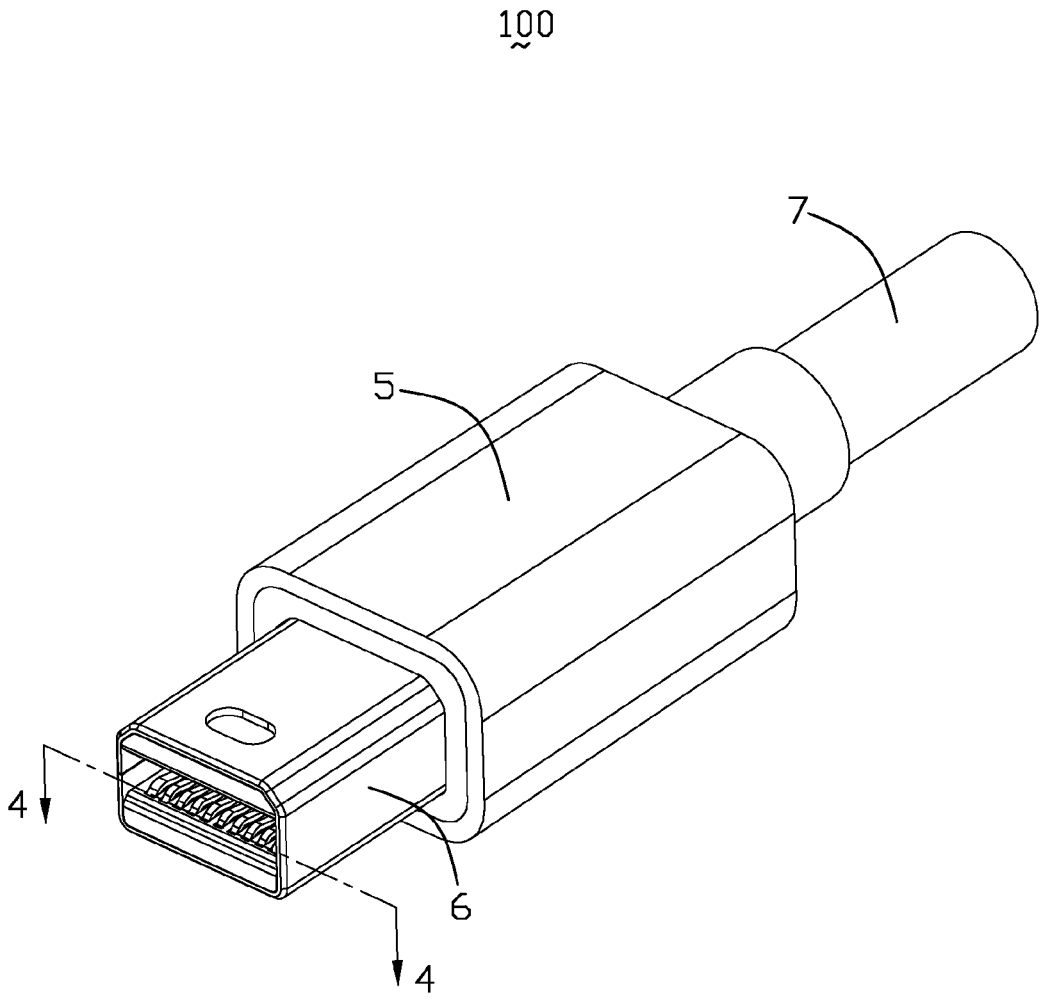
FIG. 3 is an assembled, perspective view of the electrical connector.
Figure 4:
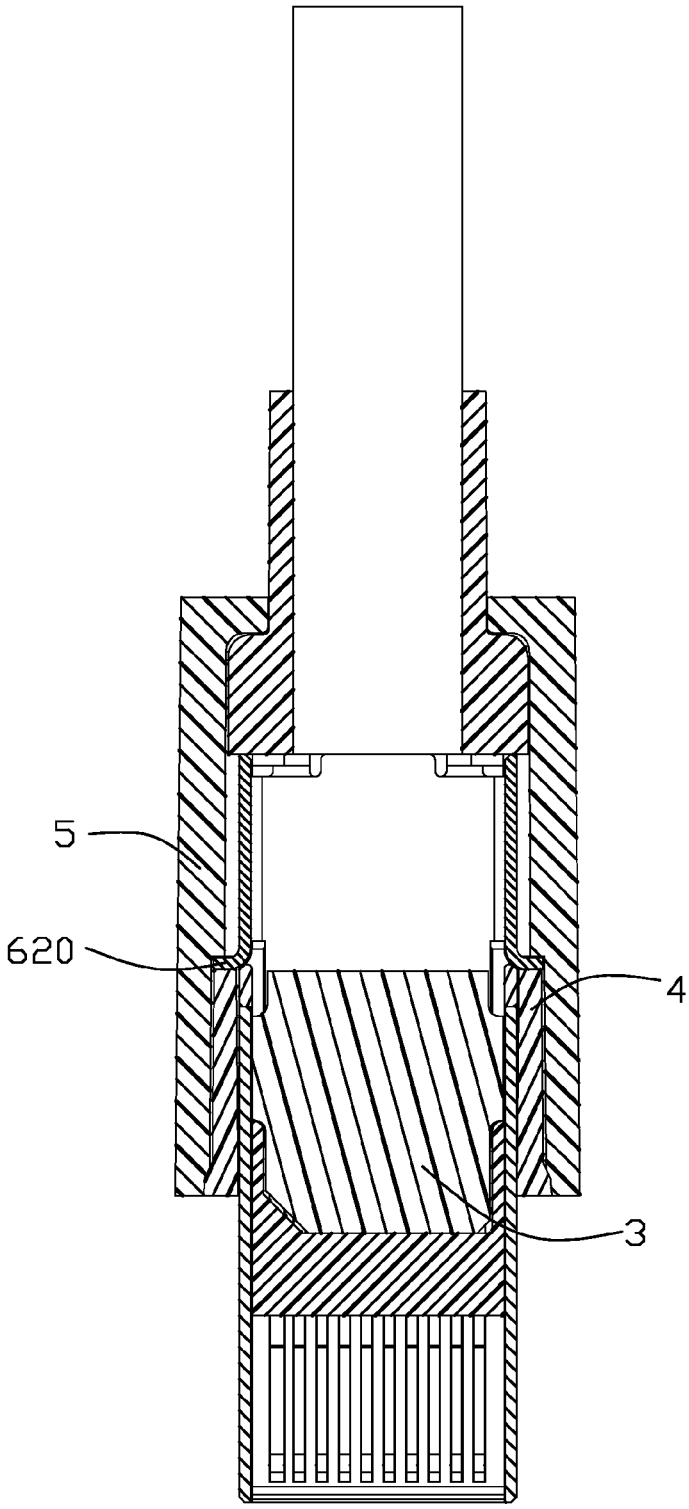
FIG. 4 is a cross-section view of FIG. 3 taken along line 4-4.
Figure 5:
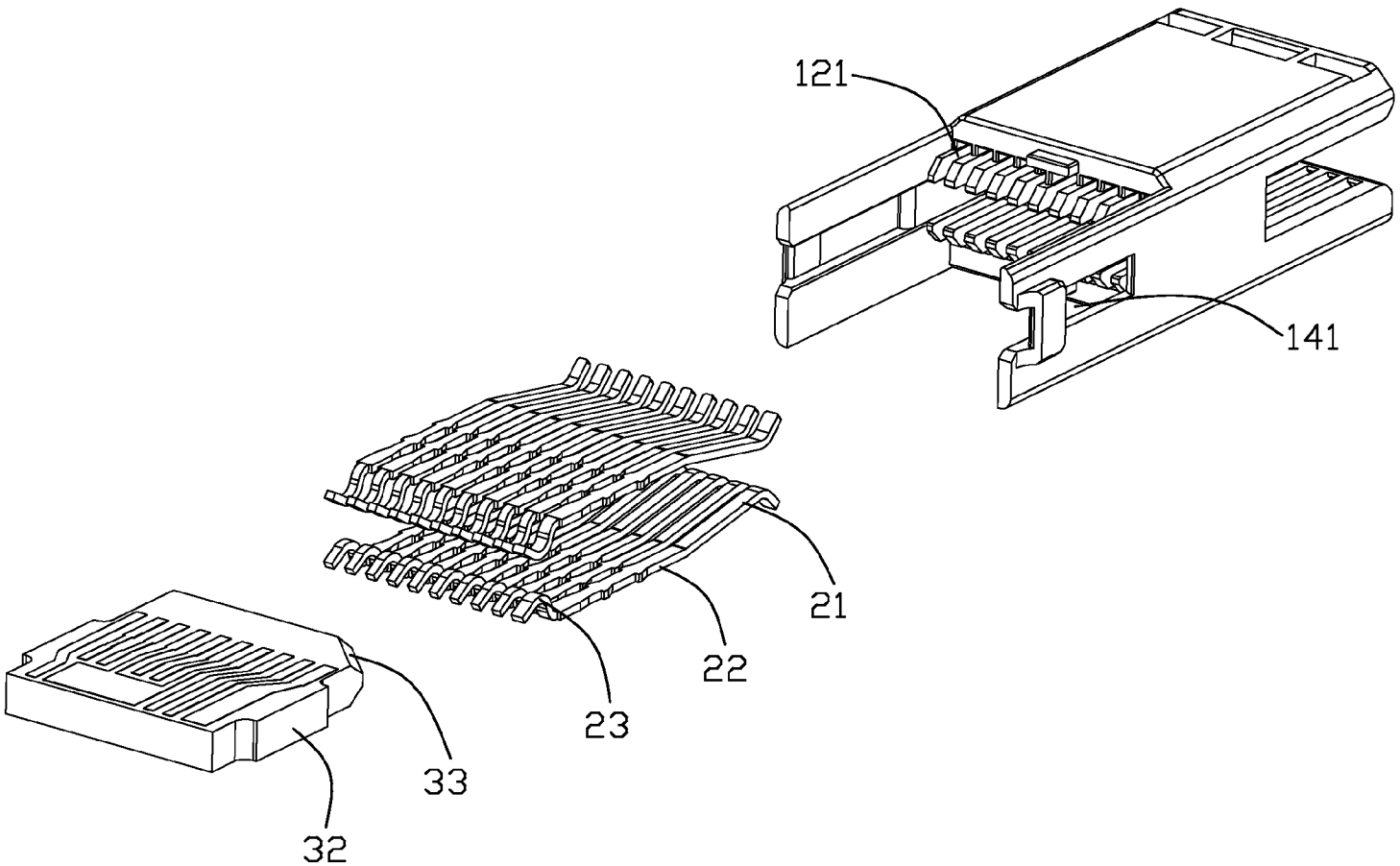
FIG. 5 is a partially exploded, perspective view of the electrical connector.
Figure 6:
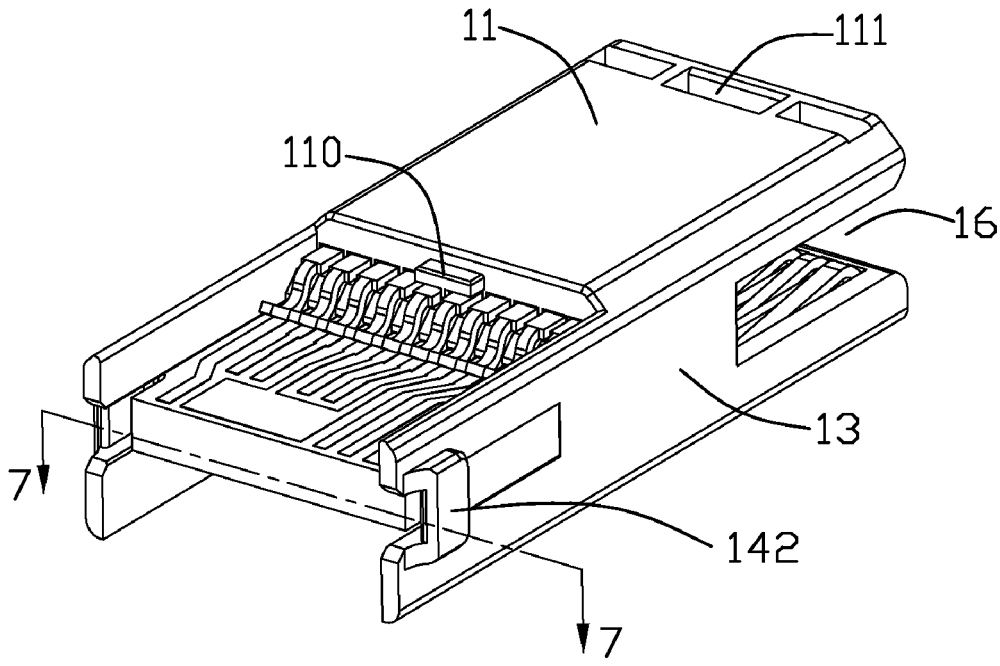
FIG. 6 is assembled, perspective view of the FIG. 5.
Figure 7:
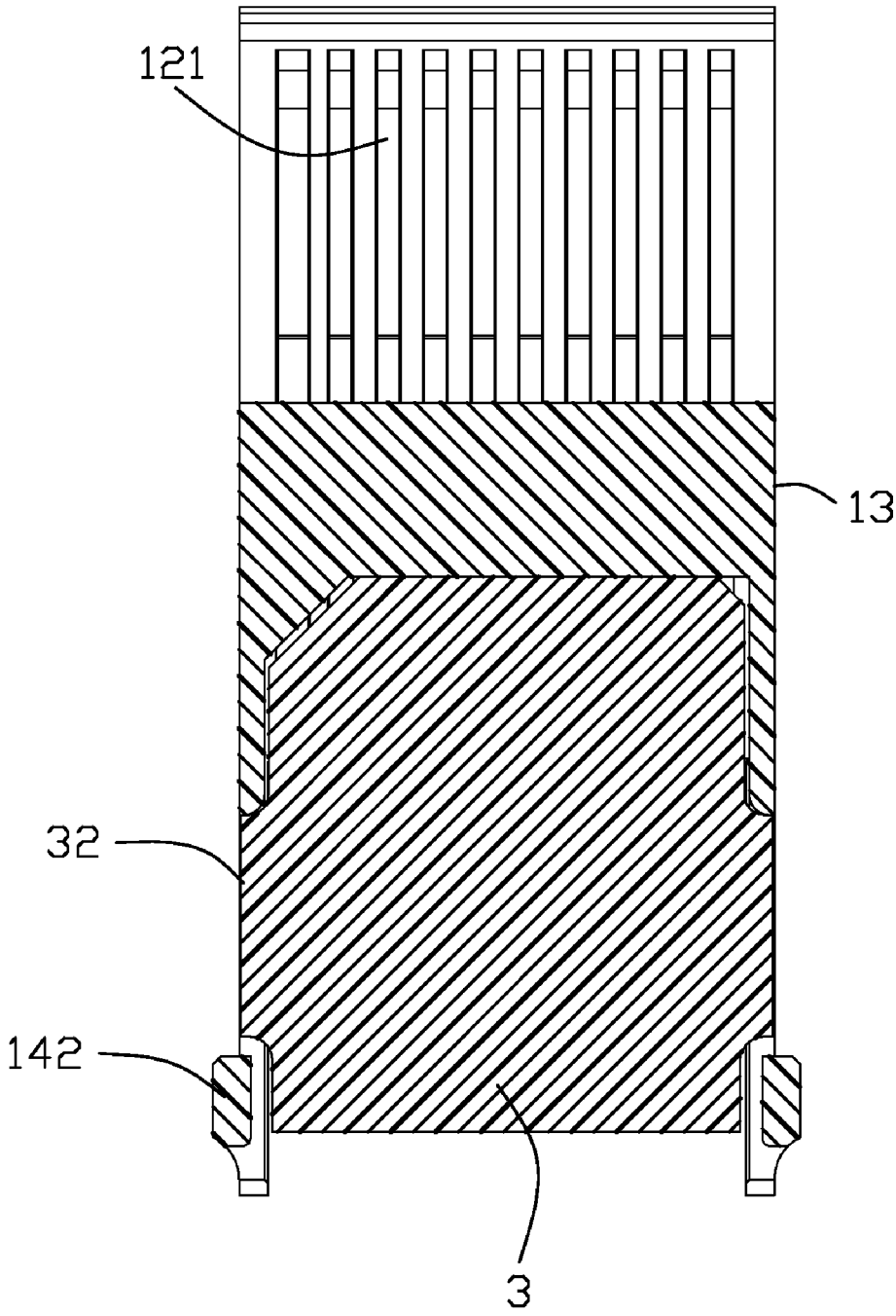
FIG. 7 is a cross-section view of FIG. 6 taken along line 7-7.

Referring to FIGS. 1-7, an electrical connector 100 in accordance with the present invention comprises an insulative housing 1, a plurality of contacts 2 received in the housing 1, a PCB 3 assembled to the housing 1 and electrically connected to the contacts 2, a metal shell 6 enclosing the housing 1, a insulative cover partly enclosing outside of the metal shell 6 and cable 7 electrically connected to an end of the said PCB 3. The cover includes a lid 4 and a boot 5.

The housing 1 defines a main body, and the main body is U-shaped viewed from later side, which includes a top wall 11, a bottom wall 12 generally parallel to the top wall 11, with a space 16 formed there between. A pair of side walls 13 connect with the top wall 11 and the bottom wall 12. The top wall 11 forms three recesses 111 depressed downwardly from a front end thereof. A projecting block 110 is arranged opposite to said recesses 111 at back end of the top wall 11. The top wall 11 and bottom wall 12 define a number of terminal grooves 121 in their interior sides thereof for receiving the contacts 2.

The housing 1 defines a pair of flexible/deformable arms 14 extending backwardly from back edge of the two side walls 13, the flexible arm 14 extends beyond the back edge of said top wall 11 and bottom wall 12 of the housing 1. A receiving space 15 is formed between the arms 14. The flexible arm 14, the top wall 11, a bottom wall 12 and a pair of side walls 13 of housing 1 form a U-shaped structure viewed from a top side. A length of top wall 11 and bottom wall 12 of the housing 1 is shorter than that of the housing 1 along transverse direction. The two flexible arms 14 each defines a slot 141 and a block 142 located behind the slot 141, the block 142 protrudes outward and beyond the outer side of the flexible arm 14. A guided slot (not numbered) is formed between the inside of block 142 and inside of the flexible arm 14, and a cutout (not numbered) is formed at end of the flexible arm 14. Said cutout and guided slot are communication with each other. The guided slot and the cutout extend along the mating direction, the slot 141 is adapted for fixing/positing the PCB 3 with housing 1.

The contacts 2 are divided into the upper and lower rows, and each contact 2 includes a horizontal body portion 22, a contact portion 21 extending forwardly from the body portion 22 and a tail portion 23 extending backwardly from the body portion 22. The contacts 2 are received in the terminal grooves 121 on the top wall 11 and bottom wall 12 of the housing 1, respectively. The tail portions 23 are electrically connected with cable 7 via the PCB 3.

The PCB 3 is a plate structure, which has a top surface 31 and a bottom surface (not numbered) and a number of conductive path (not numbered) disposed thereon, a front end of the conductive path connected with the terminal 2, a rear end of the conductive path connected with cable 7. The PCB 3 defines two external flanges 32 at lateral sides thereof. The flanges 32 cooperate with the slot 141 of the housing 1, and a sloped corner 33 is formed in front section of the PCB 3 to avoid mismating.

The metal shell 6 also includes a top wall 61, a bottom wall 63 and a pair of side walls 62 connected with the top wall 61 and bottom wall 63 to form a body portion. The top wall 61 defines a tab 610 extending downwardly and slantways from a middle portion thereof for cooperating with the projecting block 110 of the housing 1. The projecting block 110 can prevent the housing 1 from moving backwardly while assembling to the metal shell 6. Furthermore, the metal shell 6 defines a inverted U-shaped cable holder 611 connected to a back edge of the top wall 61. The end of bottom wall 63 forms a stub 630 extending along horizontal direction to support the cable 7, and the stub 630 also supplies a stress relief. Two stopping tab 620 extend outward and are disposed nearby the end of the two side walls 62, respectively.

The lid 4 is a frame structure and made of plastic material. The lid 4 defines a flange 41 around front end thereof, and two gap 42 are defined in back sections of side portions thereof for cooperating with the stopping tab 620 of the metal shell 6.

The boot 5 is substantially a box-shaped structure and made of plastic material, the boot 5 defines a circular hole 51 in a rear wall. Furthermore, the boot 5 also defines two ridges (shown in FIG. 4, not numbered) on inner of two later sides for engaging with the stopping tab 620 of the metal shell 6. The cable 7 includes a number of wires 71 (not shown) and a protector 72 molded onto an outer of the cable 7, the protector 72 is T-shaped and defines two ears 720 at front end. An opening direction of the gap 42 of the lid 4 is opposite to the ridge. The size of the lid 4 is smaller than that of the boot 5 along mating direction.

When assembling, firstly, the two rows of terminals 2 received in terminal grooves 121 respectively, the contact portion 21 exposed to space 16, the tail portion 23 exposed to receiving space 15, while the horizontal body portion 22 entirely received in the terminal grooves 121. Secondly, the PCB 3 assembled to housing 1 along the mating direction, the front portion of the flanges 32 of PCB 3 abutting the back face of the blocks 142, and moving along the slot 141 guiding by the guided slot, the end of the flexible/deformable arms 14 open a angle outwardly with the insertion of the flanges 32 of PCB 3 because that the distance between the two flanges 32 is larger than the two blocks 142. The back end of the flanges 32 are blocked by the block in order to prevent it from exiting the slot 141. By the steps hereinbefore, the PCB 3 is firmly fixed on the insulative housing 1, the front portion of the PCB 3 is inserted into gap between the upper and lower row of contact 2, the conductive path disposed on the top and low surface of the PCB 3 are electrical connected with the tail portion 23 of the contact 2 by welding technology. The back end of the PCB 3 is received in the space 15 sufficiently; next, conductors of the cable 71 soldered to the other side of conductive path of the PCB 3.

Then, the housing 1 is assembled to the metal shell 6 from the back-end of the metal shell 6. The projecting block 110 of the housing 1 contacted to the tab 610 of the metal shell 6, the external portion of blocks 142 of the flexible arms 14 received and hold in an aperture (not numbered) of the metal shell 6.

Then again, the lid 4 is assembled to metal shell 6 from the front end of the metal shell 6 until the gap 42 of the lid 4 interfered with the stopping tab 620 of the metal shell 6.

Finally, the boot 5 is mounted on the metal shell 6 from the other end of the metal shell 6 until the two ridges of the boot 5 mated with the stopping tab 620 of the metal shell 6. The gap 42 and ridge formed so-called cooperation structure. The ears 720 of the cable 7 are located in front of the circular hole 51 of the boot 5. The lid 4 is coated with glue on the inner and outer wall thereof for stick them firmly, the stopping tab 620 sandwiched between the lid 4 and boot 5, and the lid 4 is enwrapped the boot 5 completely. Thus, the electrical connector 100 assembled. The front area of the metal shell 6 which exposed out of the lid 4 and boot 5 formed an interface area for mating with the mating connector (not showed).

The electrical connector 100 has the stopping tab 620 which can position the lid 4 and boot 5 that assembled to the metal shell 6 along different directions, and keeps the interface area of the electrical connector 100 in a certain size.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing;

a plurality of contacts received in the housing;

a metal shell enclosing the housing and having two stopping tabs formed on two sides thereof; and an insulative cover having two parts assembled to the metal shell along a mating direction of the electrical connector and an opposite direction to the mating direction, respectively, said two parts of the cover each having a cooperation structure interfering with the stopping tabs of the metal shell;

wherein the two parts of the insulative cover include a lid and a boot, the lid assembled to the metal shell from a front portion thereof, the boot assembled to the metal shell from a rear portion thereof;

wherein the lid is a frame structure defining a flange around front end and forming two gaps on both sides thereof, the boot is a frame structure defining two ridges on all inner side thereof, and the lid and the boot interfere with the stopping tabs by the gaps and the ridges.

2. The electrical connector as claimed in claim 1, wherein an opening direction of the gap of the lid is opposite to the ridge of the boot.

3. The electrical connector as claimed in claim 2, wherein the size of the lid is smaller than that of the boot along a mating direction.

4. The electrical connector as claimed in claim 3, wherein the insulative cover partially encloses the metal shell, and the boot entirely encloses the lid.

5. The electrical connector as claimed in claim 1, wherein the housing defines a U-shaped main body viewed from a lateral side, the U-shaped main body includes a top wall, a bottom wall parallel to the top wall and a pair of side walls connected with the top wall and bottom wall.

6. The electrical connector as claimed in claim 5, wherein the housing forms a U-shaped structure viewed from a top side, the U-shaped structure and lateral U-shaped main body share the side walls of the housing.

7. The electrical connector as claimed in claim 6, wherein said electrical connector further includes a PCB, the housing has a pair of deformable arms extending rearward from the main body, the PCB is fixed to the housing by said arms.

8. The electrical connector as claimed in claim 5, wherein a length of top wall and bottom wall of the housing is shorter than that of the housing along a transverse direction.

9. An electrical connector comprising:

an insulative housing;

a plurality of contacts disposed in the housing;

a cable located in a rear portion of the housing and electrically connected to the contacts;

a metallic shell enclosing the housing and defining a pair of stopping tabs on two opposite sides;

a boot enclosing a rear portion of the shell; and a lid sandwiched between the shell and the boot radially; wherein said stopping tab is sandwiched between the lid and the boot axially.

10. An electrical connector, comprising:

an insulative housing;

a plurality of contacts received in the housing;

a metal shell enclosing the housing and having two stopping tabs formed on two sides thereof; and an insulative cover having two parts assembled to the metal shell along a mating direction of the electrical connector and an opposite direction to the mating direction, respectively, said two parts of the cover each having a cooperation structure interfering with the stopping tabs of the metal shell;

wherein the housing defines a U-shaped main body viewed from a lateral side, the U-shaped main body includes a top wall, a bottom wall parallel to the top wall and a pair of side walls connected with the top wall and bottom wall;

wherein the housing forms a U-shaped structure viewed from a top side, the U-shaped structure and lateral U-shaped main body share the side walls of the housing.

11. The electrical connector as claimed in claim 10, wherein said electrical connector further includes a PCB, the housing has a pair of deformable arms extending rearward from the main body, the PCB is fixed to the housing by said arms.

* * * * *